US006795046B2

(12) United States Patent
Janssen et al.

(10) Patent No.: US 6,795,046 B2
(45) Date of Patent: Sep. 21, 2004

(54) SELF-CALIBRATING IMAGE DISPLAY DEVICE

(75) Inventors: Peter J. Janssen, Scarborough, NY (US); Lucian Remus Albu, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 275 days.

(21) Appl. No.: 09/930,190

(22) Filed: Aug. 16, 2001

(65) Prior Publication Data

US 2003/0034941 A1 Feb. 20, 2003

(51) Int. Cl.[7] ..... G09G 3/36
(52) U.S. Cl. ..... 345/87; 345/89
(58) Field of Search ..... 345/55, 87–104, 345/74.1–83, 204, 690, 208, 210, 211, 212; 315/169.1–169.3; 348/180, 189

(56) References Cited

U.S. PATENT DOCUMENTS

| | | | | | |
|---|---|---|---|---|---|
| 4,840,462 | A | * | 6/1989 | Hartmann | 349/85 |
| 5,625,373 | A | * | 4/1997 | Johnson | 345/58 |
| 5,751,279 | A | * | 5/1998 | Okumura | 345/212 |
| 6,229,508 | B1 | * | 5/2001 | Kane | 345/82 |
| 6,331,846 | B1 | * | 12/2001 | Nakao | 345/96 |

FOREIGN PATENT DOCUMENTS

| | | | | |
|---|---|---|---|---|
| EP | 0729233 A1 | | 8/1996 | H03M/1/06 |
| EP | 0953959 A3 | | 11/1999 | G09G/3/34 |
| EP | 0953959 A2 | | 11/1999 | G09G/3/34 |
| JP | 05-265405 | * | 10/1993 | G09G/3/36 |

OTHER PUBLICATIONS

Matsueda et al: "30.1: 6–Bit–Color VGA Low–Temperature Poly–SI TFT–LCD With Integrated Digital Data Drivers" 1998 SID International Symposium Digest Of Technical Papers. vol. 29, May 17, 1998, pp. 879–882.

Furuhashi et al: "A g4–Gray–Scale Digital Signal Driver For Color TFT–LCDS" SID International Symposium Digest Of Technical Papers. vol. 25, Jun. 14, 1994, pp. 359–362.

* cited by examiner

*Primary Examiner*—Richard Hjerpe
*Assistant Examiner*—Alexander Eisen

(57) ABSTRACT

A liquid crystal display (LCD) device includes a circuit for calibrating out non-linearities in the signal processing path from received digital input data to the analog voltage produced on a data (column) line of the display, and for calibrating out differences between column drivers and column lines in the device. The device receives digital input data and in response thereto generates an analog data voltage to be applied to a column line. The device includes a circuit for generating a precision staircase reference signal, and a circuit for comparing the precision staircase reference signal voltage to the data voltage and in response thereto producing a calibration data error value which is stored in the device. One, or beneficially all, columns of the device are calibrated by stepping the digital input data through each value in its operating range and storing the corresponding calibration data error values in memory.

25 Claims, 4 Drawing Sheets

SELF-CALIBRATING IMAGE DISPLAY DEVICE

BACKGROUND OF THE INVENTION

1. Field of the Invention

This invention pertains to the field of image display devices, and more particularly to liquid crystal display devices, and to calibration circuitry for such devices.

2. Description of the Related Art

Image display devices such as liquid crystal display (LCD) devices are widely known. With reference to the following description, familiarity with conventional features of such devices will be assumed, so that only features bearing on the present invention will be described.

FIG. 1 shows relevant portions of an exemplary liquid crystal display (LCD) device 100.

The LCD device 100 comprises in relevant part: a plurality of pixels 110; a plurality of column (data) lines 120 connected to the plurality of pixels 110; a plurality of column (data) drivers 130 for supplying data to pixels 110 via the column lines 120; a plurality of column driver switches 140; a plurality of row (scanning) lines 150 connected to rows of pixels 110; and a plurality of row drivers 160 connected to the row lines 120 for selecting a row of pixels 110 to which data from the column drivers 130 is to be applied.

Typically, each pixel 110 includes a pixel switching device 112 and a storage device (pixel capacitor) 114. The pixel switching device 112, which may be a thin film transistor (TFT), is responsive to a scanning signal on the connected row line 150 to switch a data signal applied via the connected column line 120 into the storage device 114.

The LCD device 100 may be a liquid crystal on silicon (LCOS) type LCD device. In that case, the column (data) drivers 130, column driver switches 140, and/or row (scanning) drivers 160 may be integrated onto a same silicon substrate as the liquid crystal pixels 110.

Image data is provided as digital input data from an external video generator to the column drivers 130. However, the column drivers 130 must provide analog image data to the column lines 120. Hence, the image data is subjected to signal processing, including digital to analog conversion, in the column drivers 130.

Some problems with the prior art LCD device 100 will now be explained.

Variations between the column drivers 130 and column lines 120 cause a situation wherein the pixels 110 of two different column lines 120 may display different brightnesses (intensities) even though the same digital image data is applied to the column driver(s) 130 for both column lines 120. Indeed, the variations may be so great that a situation occurs wherein a column driver 130 for a first column line 120 receives first digital image data having a greater value than second digital image data received by a column driver 130 for a second column line 120, and yet the pixels 110 of the second column line 120 actually display a brighter image (greater intensity) than the pixels 110 of the first column line 120. These variations result in an undesirable display characteristic.

Moreover, the signal processing in the column drivers 130 produces non-linearities in the image data. Because of these non-linearities, the brightness range of the image data does not monotonically increase. In other words, one or more situations may occur wherein the digital image data value for a particular column line 120 is increased, but the actual displayed brightness displayed by the pixels 110 of the column line 120 decreases.

In general, propagation delays of digital and analog signals in the device 100, in addition to common circuit property variations (e.g., amplifier offsets; gain/bandwidth variations) cause brightness variations between pixels or regions (e.g., columns) of the display.

Accordingly, it would be desirable to provide an image display device with reduced or eliminated brightness level variations among pixels or columns receiving the same digital input data. It also would be desirable to provide an image display device having a brightness that monotonically increases in response to digital input data received form an external video signal generator.

SUMMARY OF THE INVENTION

Accordingly, in one aspect, an image display device includes a plurality of pixels arranged in a matrix or rows and columns, a plurality of column lines each connected to a corresponding one of the columns of pixels, at least one column driver providing a data voltage to one of the column lines, a generator producing a reference voltage, and means for comparing the reference voltage to the data voltage and in response thereto producing a calibration data error value.

In another aspect, a method of calibrating data voltage levels for image display device including a plurality of pixels arranged in a matrix of rows and columns, a plurality of column lines connected to the plurality of pixels, and a plurality of column drivers connected to the column lines and providing data to the pixels, includes: generating a reference signal; receiving P-bit digital input data having a digital input data value; producing a data voltage on one of the column lines in response to the received digital input data; and comparing the reference signal to the data voltage produced on one of the column lines and, in response thereto, generating a calibration data error value.

DETAILED DESCRIPTION

Figure 1:
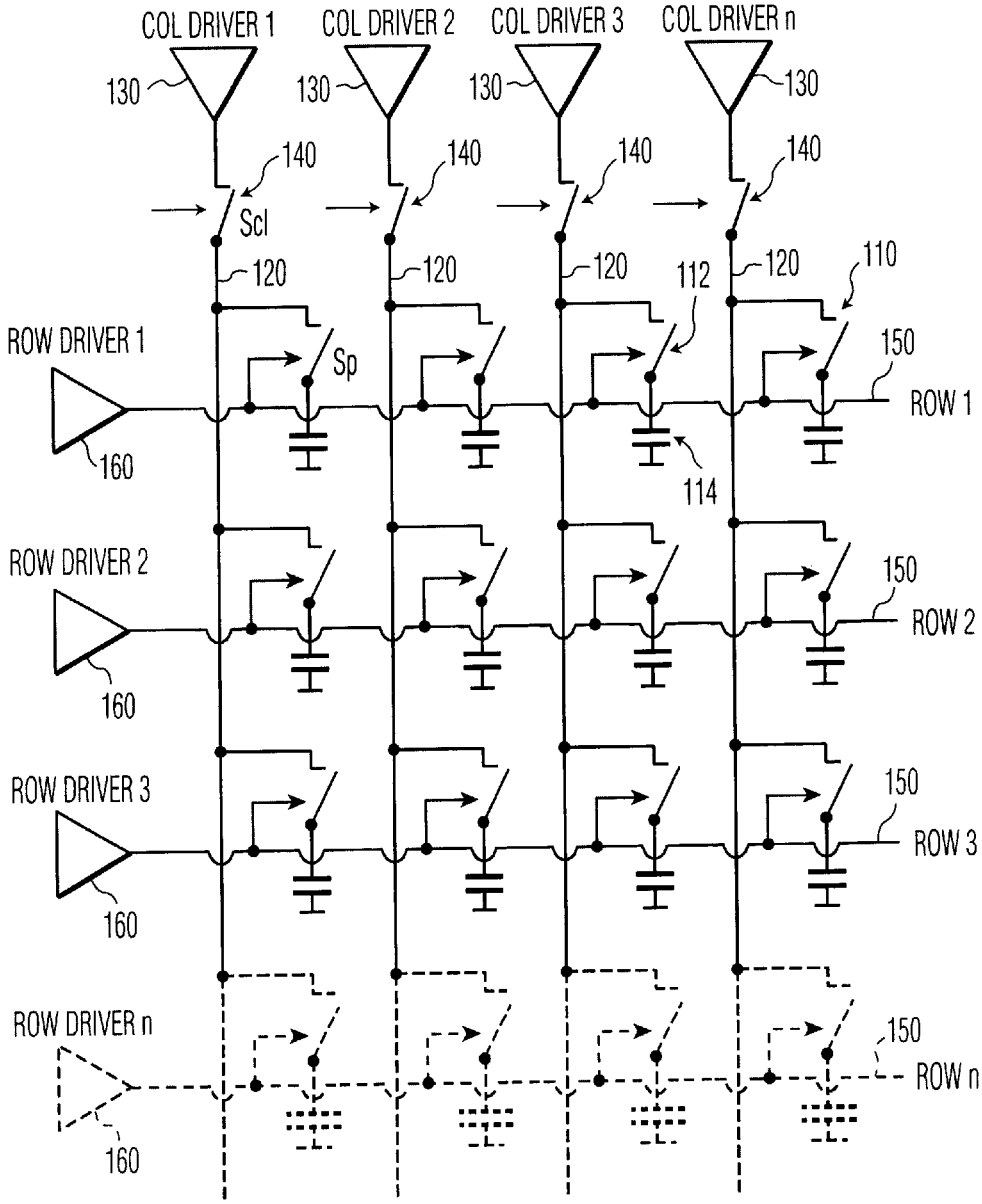
FIG. 1 shows a prior art liquid crystal display (LCD) device.
Figure 2:
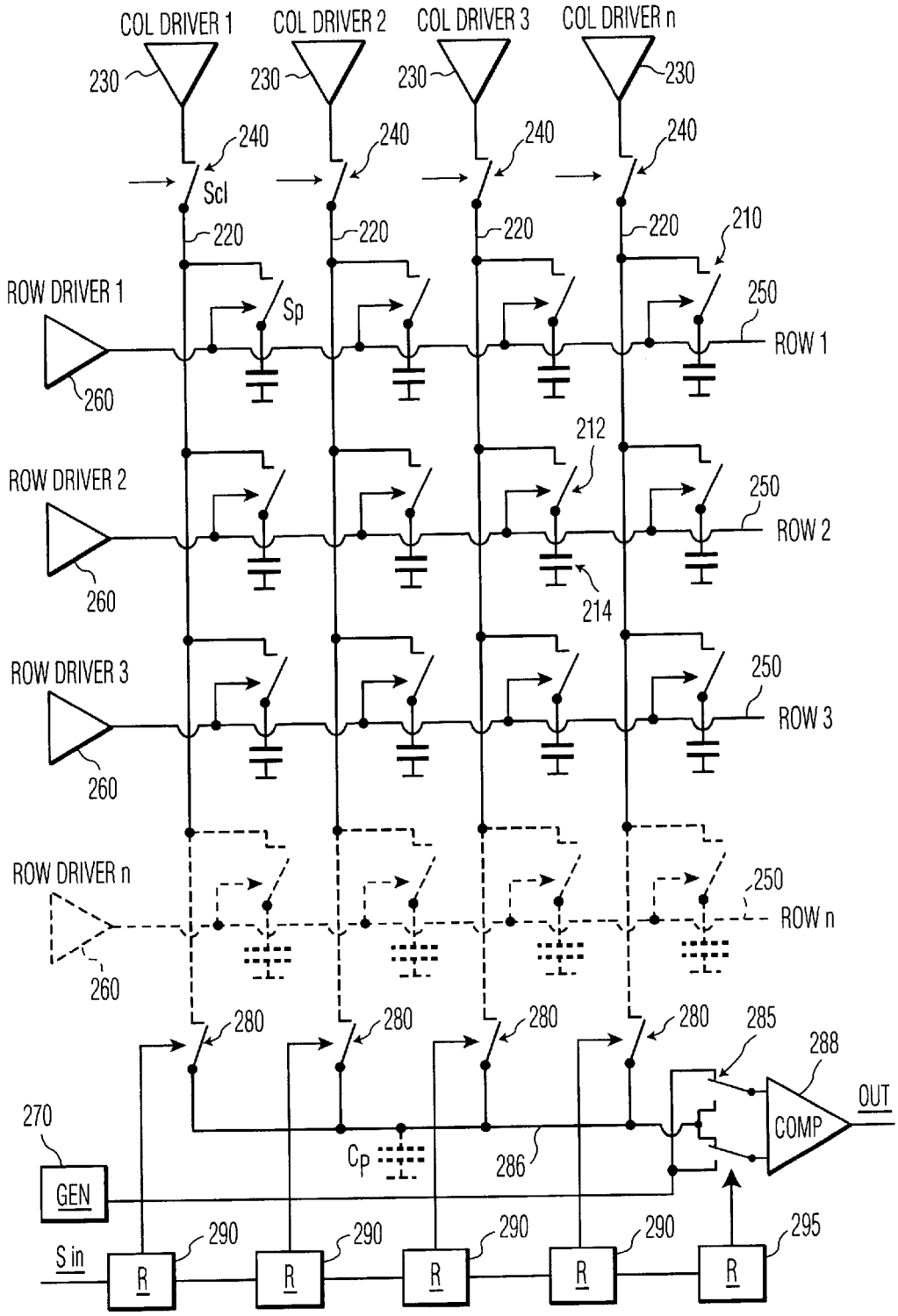
FIG. 2 shows a first embodiment of a self-calibrating LCD device.

FIG. 2 shows a first embodiment of an image display device in accordance with one or more aspects of the invention. The first embodiment is described with respect to a liquid crystal display (LCD) device 200. For clarity and simplicity, those portions of the LCD device 200 relating to the present invention are illustrated.

The LCD device 200 comprises in relevant part: a plurality of pixels 210; a plurality (M) of column (data) lines 220 connected to the plurality of pixels 210; a plurality of column (data) drivers 230 for supplying data to the pixels 210 via the column lines 220; a plurality of column driver switches 240; a plurality column driver switch registers (not shown); a plurality (N) of row (scanning) lines 250 connected to N rows of pixels 210; a plurality of row drivers 260 connected to the row lines 250 for selecting a row of pixels 210 to which data from the column drivers 230 is to be applied; a generator 270 providing a global reference signal; a plurality (M) of column test switches 280 each connected with a corresponding one of the column lines 220; a common test line 286 connected to each of the column test switches 280; a commutation switch 285 with one input connected to the column test line and a second input connected to the global reference signal from the generator 270; a comparator 288 connected to the outputs of the commutation switch 285; a plurality (M) of column test switch registers 290 each having an output connected to a control terminal of a corresponding one of the column test switches 280; and a commutation switch register 295 each having an output connected to a control terminal of the commutation switch 285.

The LCD device 200 may be a liquid crystal on silicon (LCOS) type LCD device. In that case, the column (data) drivers 230 and/or row (scanning) drivers 260 may be integrated onto a same silicon substrate as the liquid crystal pixels 210. Also, the column driver switches 240, the column driver switch registers, the column test switches 280, the commutation switch 285, the column test switch registers 290, and/or the commutation switch register 295 may be integrated onto the same substrate.

Typically, each pixel 210 includes a pixel switching device 212, having first and second terminals and a control terminal, and a storage device (pixel capacitor) 214 connected to the first terminal of the pixel switching device 212. The second terminal of the pixel switching device 212 is connected to one of the column lines 220. The pixel switching device 212, which may be a thin film transistor (TFT), is responsive to a scanning signal on the connected row line 250 to selectively connect the column line 220 to the storage device 214 and thereby to store a data signal applied via the column line 220 into the storage device 214.

Image data is provided as digital input data from an external video generator to the column drivers 230. The column drivers 230 perform signal processing, including digital to analog conversion, on the digital input data and provide analog output data to the column lines 220.

The column test switch registers 290 may be configured as a shift register. In the preferred embodiment, the column test switch registers 290 may be configured together with the commutation switch register 295 as a single shift register. Similarly, the column driver switch registers may be configured as a shift register. Beneficially, when the column test switch registers 290 and the commutation switch register 295 are configured as a shift register, data values may be supplied for the column test switch registers 290 and the commutation switch register 295 by shifting them into place using a shift enable or clock signal.

The operation of various pertinent elements of the first preferred embodiment LCD device 200 in the case of a defective column will now be explained.

During a display calibration process, a data value (e.g., a "1") is shifted into the first column test switch register 290 such that the first column test switch register 290 produces a control signal at the control terminal of the first column test switch 280 to close the first column test switch 280, connecting column 1 with the common test line 286. At this time, a data value (e.g., "0") is stored in the remainder (columns 2 through N) of the column test switch registers 290 to thereby produce control signals that open the column test switches 280 for the columns 2 through N. Also, a data value (e.g., "0") is stored in the commutation switch register 295 to provide a control signal that places the commutation switch 285 in a first position, wherein the common test line 286 is connected to a first input of the comparator 288, and the output of the generator 270 is connected to a second input of the comparator 288.

Then, digital input data is supplied by a test circuit to column driver 230 for column 1 and is stepped through its operating range of data values. For example, where the digital input data is P-bit data, the digital input data is stepped through its operating range from 0 to $(2^P-1)$ in increments of one. In response to the digital input data being stepped through its operating range of values, the column driver 230 supplies analog data to the first column line 220 and thence to the common test line 286. At this time, one of the row drivers 260 supplies a scanning signal to drive one of the row lines 250 and turn on one of the switching devices 212 of the first column. Together with a parasitic capacitance of the common test line 236, shown as $C_p$ in FIG. 2, the pixel 210 of the selected row line 250 (including the switching device 212 and the storage device 214), and the first column provides a load to the analog data from the column driver 230 and a data voltage appears on the column line 220.

Meanwhile, in synchronism with the digital input data supplied to the column driver 230 being stepped through its range of data values, the generator 270 is configured to provide a precision staircase (ramp) reference signal to the comparator 288. The precision staircase global reference signal is a monotonically and uniformly increasing staircase reference voltage which spans the range of voltages which are to be applied to the liquid crystal pixels 210 to display image data. For each digital input data value, the precision staircase reference signal produces a corresponding reference voltage. Where the maximum pixel voltage is X volts, and where the number of bits of digital data input to the device is P bits, then each step of the precision staircase reference signal is:

$$\text{Stepsize}=X/(2^P-1) \quad 1)$$

So, e.g., where X=15 volts, and P is 8 bits, then the stepsize=15/255≈0.588 volts. For each step of the digital input data value, the precision staircase reference signal has a corresponding voltage step.

It should be understood that the generator 270 may not be included in the LCD device 200, and instead may be part of an external circuit, such as a test fixture, supplying the precision staircase reference signal to the LCD device 200 during a calibration process.

At this time, for each step of the digital input data to the column driver 230 and the precision staircase global reference signal, the comparator 288 compares the data voltage produced on the first column line 220 with the voltage of the precision staircase reference signal produced by the generator 270, and in response thereto produces a first data error value. Beneficially, the first data error value produced by the comparator 288 is temporarily stored in a register or memory (not shown).

However, the first data error value will have a small difference from a true data error value between the precision staircase reference signal voltage and the actual data voltage appearing on the column line 220 due to an offset voltage of the comparator 288. Accordingly, in the preferred embodiment, the two input signals to the comparator 288 are switched and a second data error value is measured so that any offset voltage of the comparator 288 can be eliminated by averaging the magnitude of the first and second data error values.

Subsequently, while the data value (e.g., a "1") is stored in the first column test switch register 290 such that the first column test switch register 290 produces a control signal at the control terminal of the first column test switch 280 to close the first column test switch 280, connecting column 1 with the common test line 286, and while the data value (e.g., "0") is stored in the remainder (columns 2 through N) of the column test switch registers 290 to thereby open the column test switches 280 for the columns 2 through N, a second data value (e.g., "1") is stored in the commutation switch register 295 to place the commutation switch 285 in a second position, such that the common test line 286 is connected to the second input of the comparator, and the output of the generator 270 is connected to the first input of the comparator. In other words, the two input signals to the comparator 288 are switched so that a second data error value can be measured and any offset voltage of the comparator 288 can be eliminated.

Accordingly, once again, in synchronism with the digital input data supplied to column driver 230 for column 1 being stepped through its range of data values (e.g., from 0 to $2^P-1$), the precision staircase reference signal is also stepped through its corresponding range of voltages. For each step of the digital input data and the precision staircase reference signal, the comparator 288 compares the voltage produced on the first column line 220 with the precision staircase reference signal voltage produced by the generator 270. For each step of the precision digital input data and precision staircase reference signal, a second data error value is produced by the comparator 288 and temporarily stored in a register or memory (not shown).

For each digital input data value, the absolute values of the first and second data error values are averaged to produce a calibrated data error value. By commuting the outputs of the commutation switch 285 between the two inputs of the comparator 288, and averaging the first and second data error values, the calibration circuit and method cancels out any offset voltage of the comparator to produce a more accurate calibrated data error value. The calibrated data error values for each digital input data value are stored in memory to be used by the column driver 230 for the first column line 220 during a subsequent image display operation of the LCD device 200 to correct for non-linearities in the column driver 230 and column line 220 to produce an absolutely monotonic brightness range with high accuracy and high resolution.

For example, during an image display operation of the LCD device 200, in response to a digital input data value received from an external video generator, the corresponding calibrated data error value is retrieved from memory (e.g., a look-up table). In that case, the calibrated data error value retrieved from memory is added to (or subtracted from) the digital input data value to produce a calibrated digital data value to be processed by the column driver 230 to provide a calibrated analog data voltage for the appropriate column line 220.

To calibrate the second column of the LCD device 200, the data value (e.g., a "1") is shifted into the second column test switch register 290 such that the second column test switch register 290 produces a control signal at the control terminal of the second column test switch 280 to close the second column test switch 280, connecting column 2 with the common test line 286, and while the data value (e.g., "0") is stored in the remainder (columns 1 and 3 through N) of the column test switch registers 290 to thereby open the column test switches 280 for the columns 1 and 3 through N. Then, the above-described procedure is repeated to generate calibrated data error values for column 2. The procedure is repeated for columns 3 to N to produce calibrated data error values for each digital input data value for each column of the LCD device 200.

In the above example, the first and second data error values are both obtained for a first column before any of the data error values are obtained for the subsequent columns. However, it should be understood that, instead, all of the first data error values can be obtained for all of the columns 1 through N first, and then subsequently all of the second data error values for all of the columns 1 through N are obtained. Also, where the comparator offset is extremely small, or where the offset voltages of all of the comparators included in the LCD device are very closely matched, it may be possible to completely eliminate the commutation switch, and only perform a single measurement of one data error value as the calibrated data error value for each digital input data value.

Figure 3:
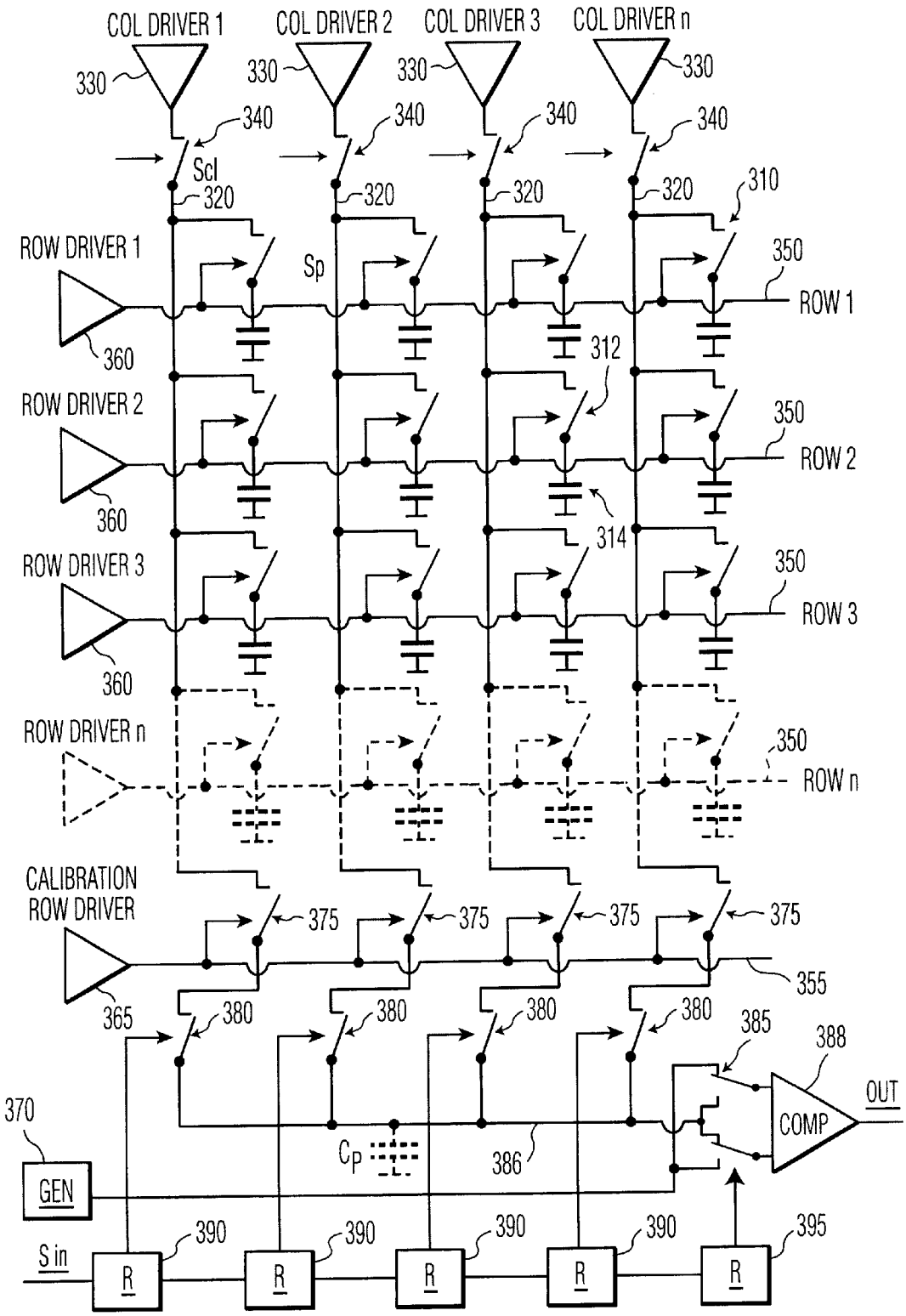
FIG. 3 shows a second embodiment of a self-calibrating LCD device.

FIG. 3 shows a second embodiment of an image display device in accordance with one or more aspects of the invention. The second embodiment is described with respect an LCD device 300.

The second embodiment LCD device 300 operates similarly to the first embodiment LCD device 200, except that the second embodiment LCD device 300 includes a dedicated calibration row driver 365 connected to a dedicated calibration row line 355, which is further connected to a plurality of dedicated calibration switches 375. Beneficially, the calibration switches 375 are identical to the pixel switching devices 312. Accordingly, during calibration of the LCD device 300, the dedicated calibration row driver 365 supplies a scanning signal to the dedicated calibration row line 355 to turn on one of the dedicated calibration switches 375 of the column currently being calibrated. Together with the parasitic capacitance of the common test line 386, shown as $C_p$ in FIG. 3, the dedicated calibration switch 375 of column currently being calibrated provides a load to the analog data from the column driver 330. Because the calibration row 365 does not include the storage devices 314, a load provided to a column line 320 during calibration is reduced and closer to the load present on the column line when an actual pixel 310 is driven during an image display operation.

Figure 4:
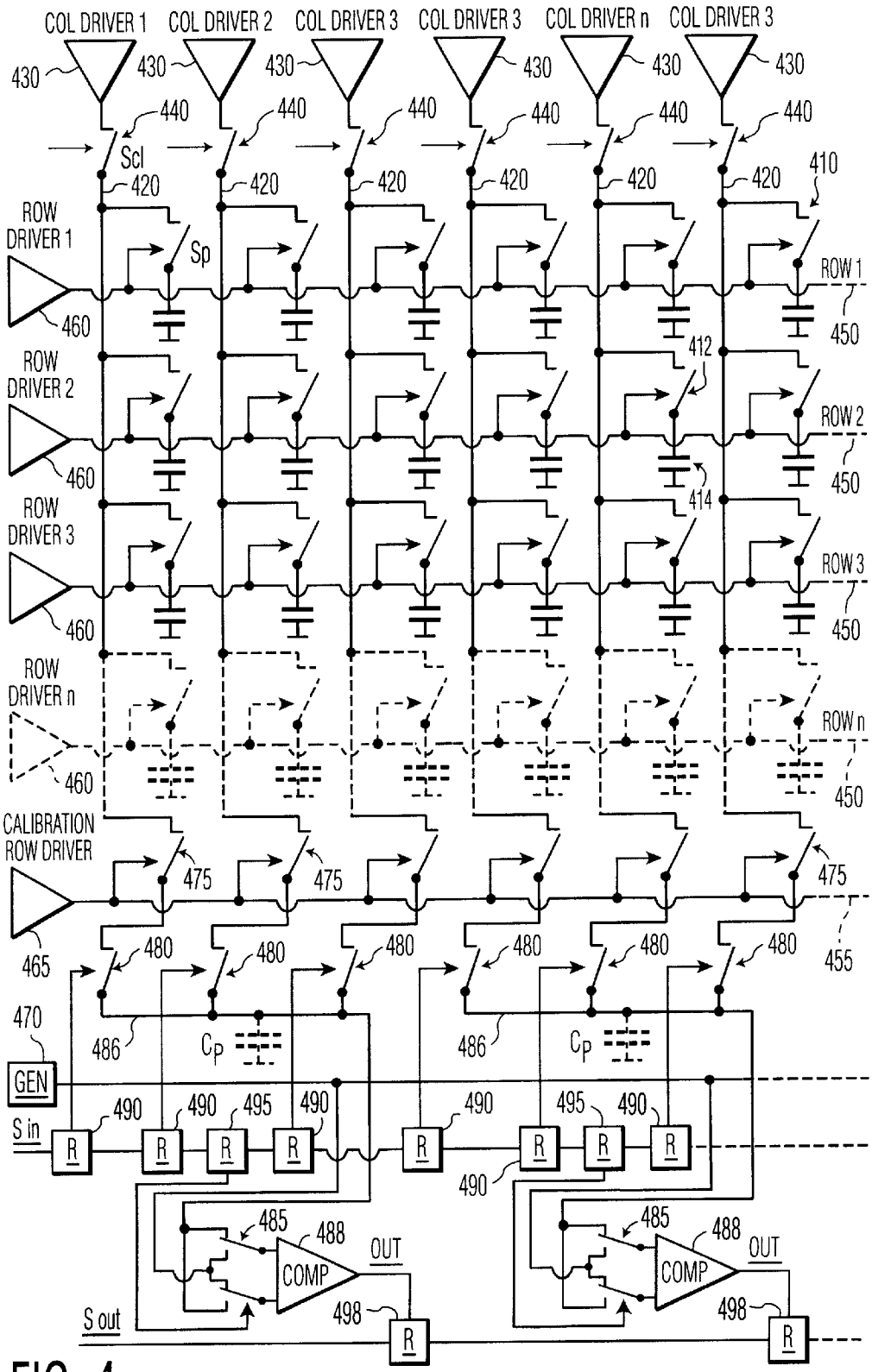
FIG. 4 shows a third embodiment of a self-calibrating LCD device.

FIG. 4 shows a third preferred embodiment LCD device 400 in accordance with one or more aspects of the invention. For clarity and simplicity, those portions of the LCD device 400 relating to the present invention are illustrated.

The third embodiment LCD device 400 operates similarly to the second embodiment LCD device 300, except that the third embodiment LCD device 300 includes a plurality of comparators 488, a plurality of commutation switches 485 each associated with a comparator 488, and a plurality of calibration test value registers 498 each associated with a comparator 488. In a preferred embodiment, the calibration test value registers 498 are configured as a shift register.

In the third embodiment, columns are grouped together and a separate common test line 486 and comparator 488 is dedicated to each group of columns. Although the third embodiment includes extra circuitry compared to the first and second embodiments, it has the following advantages. First, by selecting the number of column lines in a group, and the length of each common test line 486, the load impedance provided to a column line 420 by the parasitic capacitance $C_p$ during calibration can be tailored to more closely match the load present on the column line when an actual pixel 410 is driven during an image display operation. Second, columns in different groups may be addressed simultaneously during the calibration process, the calibration process may be performed more rapidly.

While preferred embodiments are disclosed herein, many variations are possible which remain within the concept and scope of the invention. For example, the commutation switch described above with respect to the preferred embodiments can be replaced by any other combination of switches or other circuits that will switch the terminals at which the two input signals are provided to the comparator. It is also possible that some or all of the column switches could be replaced with a multi-pole, multi-throw switch. Such variations would become clear to one of ordinary skill in the art after inspection of the specification, drawings and claims herein. Accordingly, the invention therefore is not to be restricted except within the spirit and scope of the appended claims.

What is claimed is:

1. A liquid crystal display (LCD) device, comprising:

a plurality of pixels arranged in a matrix of rows and columns, each pixel including, a pixel switching device having first and second terminals and a control terminal, and a storage device connected to the first terminal of the pixel switching device;

a plurality of column lines connected to the second terminals of the pixel switching devices;

a plurality of column drivers connected to and providing data voltages to the column lines;

a plurality of scanning lines connected to the control terminals of the pixel switching devices for selectively connecting the first and second terminals of the pixel switching devices;

at least a first column switch having first and second terminals, the first terminal connected to a selected one of the column lines, and responsive to a corresponding control signal, selectively supplying the data voltage on the selected column line to the second terminal of the first column switch;

a first comparator having two inputs receiving the reference voltage and the data voltage on the selected column line, and an output producing a first calibration data error value representing a difference between the reference voltage and the data voltage on the selected column line; and a commutation switch having two input terminals, two output terminals and a control terminal, the two input terminals receiving, respectively, the data voltage on the selected column line from the first column switch and the reference voltage, the two output terminals providing to the two inputs of the first comparator the reference voltage and the data voltage on the selected column line from the first column switch, and the control terminal controlling which of the two input terminals is connected to which of the two output terminals.

2. The LCD device of claim 1, further comprising at least one calibration switch, each calibration switch having a first terminal connected to a corresponding column line, a second terminal connected to a corresponding column switch and a control terminal for closing the calibration switch only during a calibration procedure.

3. The LCD device of claim 1, further comprising a plurality of calibration switches corresponding to the plurality of column lines, each said calibration switch having a first terminal directly connected to a corresponding column line, a second terminal connected to a corresponding column switch and a control terminal for closing the calibration switch during a calibration procedure, wherein all of the calibration switches are closed simultaneously during the calibration procedure and wherein none of the calibration switches are included in any of the pixels.

4. The LCD device of claim 1, further comprising a plurality of calibration switches corresponding to the plurality of column lines, each said calibration switch having a first terminal directly connected to a corresponding column line, a second terminal connected to a corresponding column switch and a control terminal for closing the calibration switch during a calibration procedure, wherein all of the control terminals of the calibration switches are directly connected together and wherein none of the calibration switches are included in any of the pixels.

5. The LCD device of claim 1, further comprising:

at least a second column switch having first and second terminals, the first terminal connected to a second selected one of the column lines, and responsive to a corresponding second control signal, selectively supplying the data voltage on the second selected column line to the second terminal of the column switch; and a second comparator having two inputs receiving the reference voltage and the data voltage on the second selected column line, and an output producing a second calibration data error value representing a difference between the reference voltage and the data voltage on the second selected column line, at a same time that that the first comparator produces the first calibration data error value.

6. The LCD device of claim 2, further comprising a calibration row driver activated only during a calibration procedure and providing a control signal to the control terminal of the calibration switch.

7. A liquid crystal display (LCD) device, comprising:

a plurality of pixels arranged in a matrix of rows and columns, each pixel including, a pixel switching device having first and second terminals and a control terminal, and a storage device connected to the first terminal of the pixel switching device;

a plurality of column lines connected to the second terminals of the pixel switching devices;

a plurality of column drivers connected to and providing data voltages to the column lines;

a plurality of scanning lines connected to the control terminals of the pixel switching devices for selectively connecting the first and second terminals of the pixel switching devices;

at least one column switch having first and second terminals, the first terminal connected to a selected one of the column lines, and responsive to a corresponding control signal, selectively supplying the data voltage on the selected column line to the second terminal of the column switch;

a comparator having a first input connected to the column switch and receiving the data voltage on the selected column line from the column switch, a second input receiving a reference voltage, and an output producing a calibration data error value representing a difference between the reference voltage and the data voltage; and a voltage generator generating the reference voltage as a staircase reference signal.

8. The LCD device of claim 7, further comprising at least one calibration switch not included in any of the pixels, each calibration switch having a first terminal connected to a corresponding column line, a second terminal connected to a corresponding column switch and a control terminal for closing the calibration switch during a calibration procedure.

9. The LCD device of claim 8, further comprising a calibration row driver providing a control signal to the control terminal of the calibration switch.

10. A method of calibrating data voltage levels for image display device including a plurality of pixels arranged in a matrix of rows and columns, a plurality of column lines connected to the plurality of pixels, and a plurality of column drivers connected to the column lines and providing data to the pixels, the method comprising:

(a) generating a reference signal;

(b) receiving P-bit digital input data having a digital input data value;

(c) producing a data voltage on one of the column lines in response to the received digital input data; and (d) comparing the reference signal to the data voltage produced on one of the column lines and, in response thereto, generating a calibration data error value, said comparing of the reference signal to the data voltage, comprising:

supplying the reference signal and the data voltage to first and second inputs, respectively, of a comparator;

generating a first data error value;

supplying the reference signal and the data voltage to second and first inputs, respectively, of the comparator;

generating a second data error value; and generating the calibration data error value from the first and second data error values.

11. The method of claim 10, further comprising storing the calibration data error value.

12. The method of claim 10, wherein calculating an absolute value of the calibration data error value comprises averaging absolute values of the first and second data error values.

13. The method of claim 10, wherein the steps (a) through (d) are repeated for each of the plurality of column lines of the image display device.

14. The method of claim 10, further comprising:

providing a scanning signal to turn on a calibration switch connected to the one column line, the calibration switch not being included in any of the pixels;

providing the data voltage from the column line to a column switch via the calibration switch; and providing the data voltage from the column switch to a comparator for performing step (d) in response to a control signal for the column switch.

15. A method of calibrating data voltage levels for image display device including a plurality of pixels arranged in a matrix of rows and columns, a plurality of column lines connected to the plurality of pixels, and a plurality of column drivers connected to the column lines and providing data to the pixels, the method comprising:

(a) generating a reference signal;

(b) receiving P-bit digital input data having a digital input data value;

(c) producing a data voltage on one of the column lines in response to the received digital input data;

(d) comparing the reference signal to the data voltage produced on one of the column lines and, in response thereto, generating a calibration data error value;

(e) while performing step (c), producing a second data voltage on a second one of the column lines in response to the received digital input data; and (f) while performing step (d), comparing the reference signal to the second data voltage produced on the second one of the column lines and, in response thereto, generating a second calibration data error value.

16. A method of calibrating data voltage levels for image display device including a plurality of pixels arranged in a matrix of rows and columns, a plurality of column lines connected to the plurality of pixels, and a plurality of column drivers connected to the column lines and providing data to the pixels, the method comprising:

(a) generating a reference signal;

(b) receiving P-bit digital input data having a digital input data value;

(c) producing a data voltage on one of the column lines in response to the received digital input data;

(d) comparing the reference signal to the data voltage produced on one of the column lines and, in response thereto, generating a calibration data error value; and (e) repeating the steps (a) through (d) for a plurality of digital input values spanning a range of 0 to 2P−1.

17. The method of claim 16, wherein the steps (a) through (e) are repeated for each column line of the image display device.

18. An image display device, comprising:

a plurality of pixels arranged in a matrix of rows of columns;

a plurality of column lines each connected to a corresponding one of the columns of pixels;

a column driver providing a data voltage to one of the column lines; and a first comparator for comparing the data voltage to a reference voltage and, in response thereto, producing a first calibration data error value representing a difference between the data voltage and the reference voltage, said first comparator having two inputs receiving the reference voltage and the data voltage; and a commutation switch having two input terminals receiving the reference voltage and the data voltage, two output terminals providing the reference voltage and the data voltage to the two inputs of the first comparator, and a control terminal for controlling which of the two input terminals is connected to which of the two output terminals.

19. The device of claim 18, further comprising a column switch responsive to a corresponding control signal to selectively connect the one column line and provide the data voltage to one of the two inputs of the comparator.

20. The device of claim 18, further comprising:

at least one column switch having first and second terminals, the first terminal connected to a selected one of the column lines, and responsive to a corresponding control signal, selectively supplying the data voltage on the selected column line to the second terminal of the column switch; and at least one calibration switch, each calibration switch having a first terminal connected to a corresponding column line, a second terminal connected to a corresponding column switch, and a control terminal for closing the calibration switch only during a calibration procedure.

21. The device of claim 18, comprising:

a second column driver providing a second data voltage to a second one of the column lines; and a second comparator for comparing the reference voltage to the second data voltage and in response thereto producing a second calibration data error value.

22. The device of claim 21, wherein the first and second calibration data error values are produced at a same time.

23. The device of claim 18, further comprising means for storing the calibration data error value.

24. The device of claim 20, further comprising a calibration row driver activated only during a calibration procedure and providing a control signal to the control terminal of the calibration switch.

25. The device of claim 18, further comprising:

a plurality of column switches having first and second terminals, the first terminal connected to a selected one of the column lines, and responsive to a corresponding control signal, selectively supplying the data voltage on the selected column line to the second terminal of the column switch; and a plurality of calibration switches corresponding to the plurality of column lines, each said calibration switch having a first terminal directly connected to a corresponding column line, a second terminal connected to a corresponding column switch and a control terminal for closing the calibration switch during a calibration procedure, wherein all of the calibration switches are closed simultaneously during the calibration procedure and wherein none of the calibration switches are included in any of the pixels.

* * * * *